US009733017B2

(12) United States Patent
O'Keeffe et al.

(10) Patent No.: US 9,733,017 B2
(45) Date of Patent: Aug. 15, 2017

(54) QUARTZ POURING AND CASTING SYSTEM FOR NON-WETTING AMORPHOUS ALLOYS

(71) Applicant: Crucible Intellectual Property, LLC, Rancho Santa Margarita, CA (US)

(72) Inventors: Sean Timothy O'Keeffe, Tustin, CA (US); Adam A. Verreault, Rancho Santa Margarita, CA (US); Michael Deming, Trabuco Canyon, CA (US); Glenton Jelbert, Foothill Ranch, CA (US); Stephanie O'Keeffe, Tustin, CA (US); Adrian Lopez, Rancho Santa Margarita, CA (US)

(73) Assignee: CRUCIBLE INTELLECTUAL PROPERTY, LLC., Rancho Santa Margarita, CA (US)

( * ) Notice: Subject to any disclaimer, the term of this patent is extended or adjusted under 35 U.S.C. 154(b) by 118 days.

(21) Appl. No.: 14/572,107

(22) Filed: Dec. 16, 2014

(65) Prior Publication Data

US 2016/0091250 A1 Mar. 31, 2016

Related U.S. Application Data

(60) Provisional application No. 62/056,140, filed on Sep. 26, 2014.

(51) Int. Cl.
*C22C 45/00* (2006.01)
*C22B 9/16* (2006.01)
(Continued)

(52) U.S. Cl.
CPC ..... *F27B 14/10* (2013.01); *B22D 25/06* (2013.01); *B22D 41/00* (2013.01); *B22D 41/04* (2013.01);
(Continued)

(58) Field of Classification Search
CPC ..... F27B 14/10; F27B 14/02; F27B 14/04; B22D 25/06; B22D 41/00; B22D 41/04; F27D 3/14; C22B 9/16; C22C 45/00
See application file for complete search history.

(56) References Cited

U.S. PATENT DOCUMENTS 100,826 A * 3/1870 Wells ..... B60R 1/06 164/335
5,746,876 A * 5/1998 Chen ..... G01N 1/12 156/345.15
(Continued)

FOREIGN PATENT DOCUMENTS

CN 103938127 A * 7/2014
GB 1328057 A * 8/1973

OTHER PUBLICATIONS

Derwent Acc N. 2014-S66074 for the patent family including CN 103938127 A published Jul. 23, 2014 by Hu et al.*
(Continued)

*Primary Examiner* — George Wyszomierski
*Assistant Examiner* — Tina M McGuthry Banks
(74) *Attorney, Agent, or Firm* — Foley & Lardner LLP

(57) ABSTRACT

Described herein is a crucible with a rod fused thereon to optimize pouring of molten material, and method of using the same. The crucible has a body configured for receipt of an amorphous alloy material in a vertical direction, and the rod extends in a horizontal direction from the body. The body of the crucible and the rod are formed from silica or quartz. The rod may be fused to the body of the crucible and provided off a center axis so that pouring molten material is improved when the crucible is rotated.

23 Claims, 15 Drawing Sheets

(51) Int. Cl.

| | |
|---|---|
| ***F27B 14/10*** | (2006.01) |
| ***B22D 25/06*** | (2006.01) |
| ***B22D 41/04*** | (2006.01) |
| ***B22D 41/00*** | (2006.01) |
| ***F27D 3/14*** | (2006.01) |
| ***F27B 14/02*** | (2006.01) |
| ***F27B 14/04*** | (2006.01) |
| ***F27B 5/04*** | (2006.01) |
| ***F27B 5/12*** | (2006.01) |
| *F27B 14/08* | (2006.01) |
| *F27D 5/00* | (2006.01) |

(52) U.S. Cl.
CPC ..... *C22B 9/16* (2013.01); *C22C 45/00* (2013.01); *F27B 5/04* (2013.01); *F27B 5/12* (2013.01); *F27B 14/02* (2013.01); *F27B 14/04* (2013.01); *F27D 3/14* (2013.01); *F27B 2014/045* (2013.01); *F27B 2014/0831* (2013.01); *F27D 2005/0075* (2013.01)

(56) References Cited

U.S. PATENT DOCUMENTS 8,936,664 B2 * 1/2015 Waniuk ..... C22C 1/002 148/538
2006/0032603 A1 * 2/2006 Doty ..... B22D 41/04 164/335
2013/0044785 A1 * 2/2013 Holms ..... H05B 6/26 373/143
2014/0202597 A1 * 7/2014 Waniuk ..... F27D 1/0006 148/538

OTHER PUBLICATIONS

Hu et al. CN 103938127 A published Jul. 23, 2014. Machine translation.*
"Pyrex." How Pyrex Is Made—Material, Production Process, Manufacture, Making, History, Used, Processing, Components. N.p., Mar. 26, 2006. Web. Dec. 9, 2016. <http://www.madehow.com/Volume-7/Pyrex.html>.*
"Pyrex." Collectors Weekly. Market Street Media, Aug. 7, 2012. Web. Dec. 13, 2016. <http://www.collectorsweekly.com/kitchen/pyrex>.*
"All Brands." Visions Glass Cookware—Shop World Kitchen. N.p., Nov. 7, 2010. Web. Dec. 9, 2016. <http://www.shopworldkitchen.com/visions/>.*
"Sand Casting." Sand Casting. Ningbo Fly Engineering Machinery Co.,Ltd., 2013. Web. Dec. 12, 2016.*
"Foundry Manual—Part 3." Foundry Manual. Washington DC: Navy Department, 1958. 139-43. Foundry Manual—Part 3. San Francisco Maritime National Park Association, 2013. Web. Dec. 12, 2016.*
"Cantilever." Merriam-Webster. Merriam-Webster, n.d. Web. Nov. 29, 2016. <https://www.merriam-webster.com/dictionary/cantilever%5B1%5D>.*

* cited by examiner

QUARTZ POURING AND CASTING SYSTEM FOR NON-WETTING AMORPHOUS ALLOYS

CROSS REFERENCE RELATED APPLICATION(S)

This application claims priority to U.S. Provisional Patent Application No. 62/056,140, filed Sep. 26, 2014, which is hereby incorporated by reference in its entirety.

FIELD

The described embodiments relate generally to a crucible used for melting materials.

BACKGROUND

When vacuum induction melting amorphous alloy material, there is a need for an effective means of producing clean alloy feedstock (i.e. low oxygen, carbon, nitrogen, other metallic impurities). Metal metalloid glasses (B, Si, P, C) cannot be cast using water-cooled boat designs. Also, it has been noted that a PE-based alloy (e.g., when made in a steel mold) was crystallized when the PE-based alloy was heated in a Au-boat. Such crystallization is undesirable as it reduces the quality of a molded or cast product (e.g., brittle and undesirable effects, including fragility). Alternatively, for example, some older generation die-casting equipment has utilized graphite crucibles. However, degradation of the crucible was prevalent and caused significant contamination over time. Contamination (such as carbon) could also seed crystals in these glasses.

A need exists to develop a crucible that can be used for melting materials and that can minimize the contamination and crystallization of the alloys by the elements of the crucible material. Controlling the temperature of the crucible is also necessary because at higher temperatures there tends to typically be more contamination (such as with a graphite or ceramic crucible).

SUMMARY

It is one aspect of this disclosure to provide a crucible having a rod attached thereto. The crucible has a body configured for receipt of an amorphous alloy material in a vertical direction. The rod extends in a horizontal direction from the body. The body of the crucible and the rod are formed from silica or quartz.

Another aspect of this disclosure provides a method. The method includes providing an amorphous alloy material for melting in a container; and heating the amorphous alloy material for melting in the container using a heat source to a temperature above a melting temperature of the amorphous alloy material. The container includes silica and the amorphous alloy material for melting does not wet or dissolve the container substantially during the method of melting.

Yet another aspect of this disclosure provides a method. The method includes providing an amorphous alloy material for melting in a container; and heating the amorphous alloy material for melting in the container using a heat source to a temperature above a melting temperature of the amorphous alloy material. The container includes silica and has a rod attached thereto extending in a horizontal direction from the body. The container also has an opening for receipt of an amorphous alloy material in a vertical direction. The amorphous alloy material for melting does not wet or dissolve the container substantially during the method of melting.

Other aspects and advantages of the present invention will become apparent from the following detailed description, the accompanying drawings, and the appended claims.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
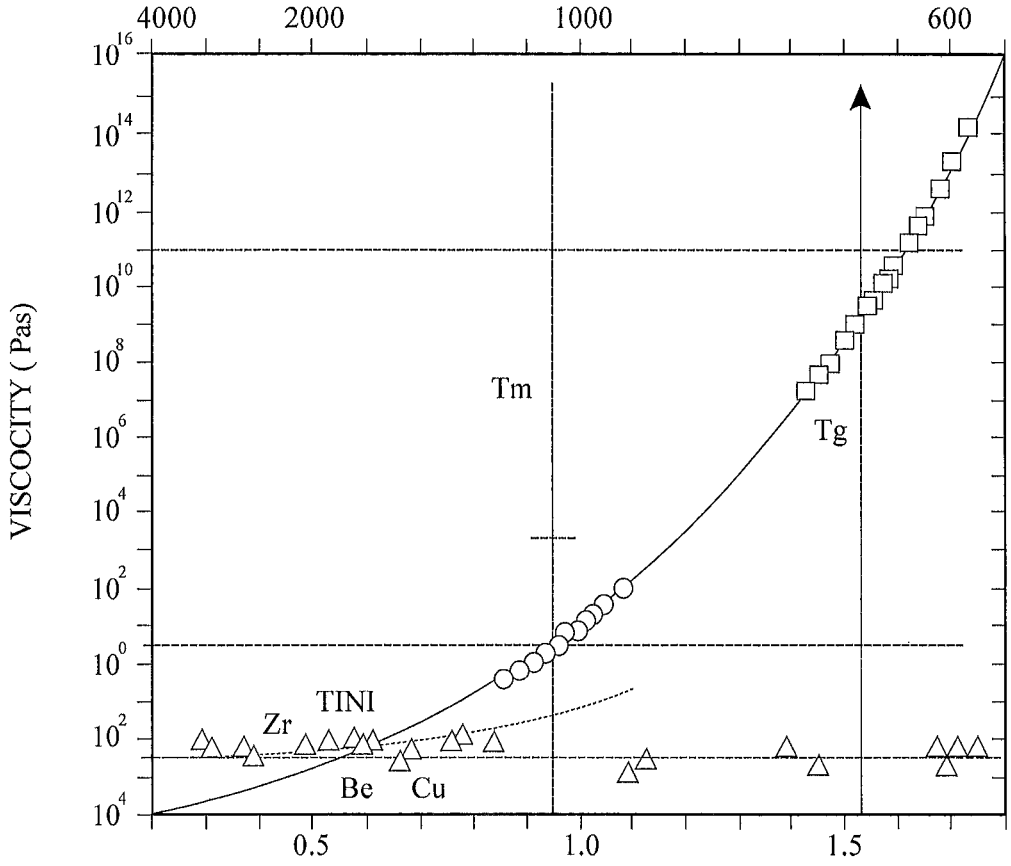
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
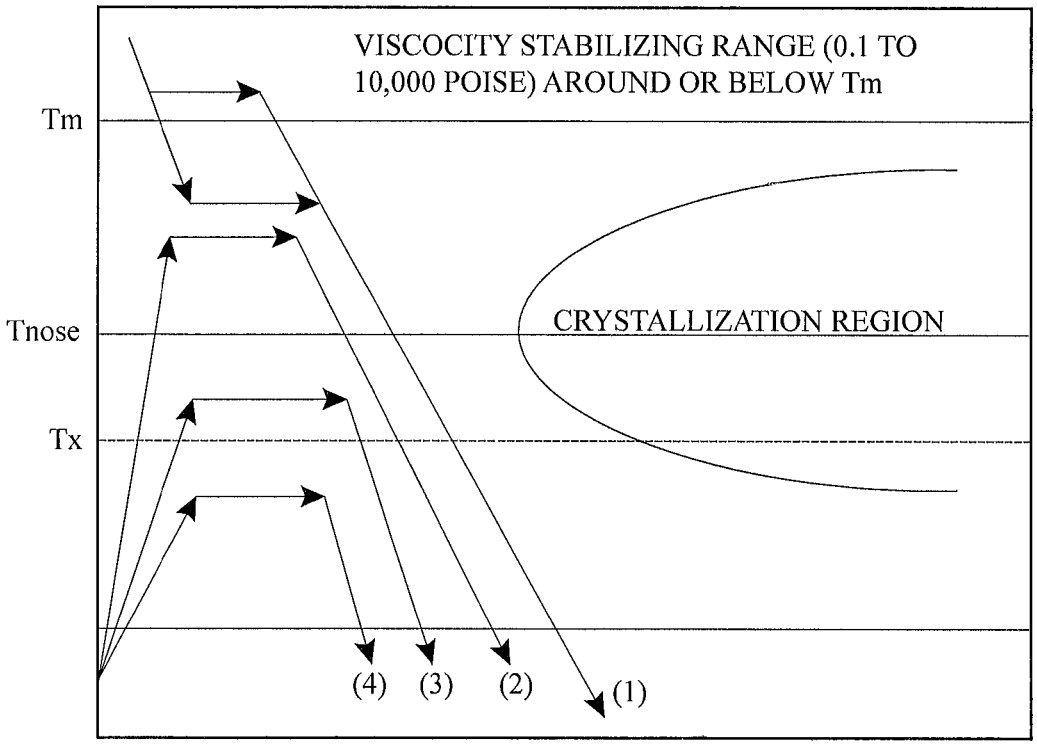
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between $10^{12}$ Pa s at the glass transition temperature down to $10^{5}$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal"

refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, has sium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x,x')=\langle s(x),s(x')\rangle$.

In the above function, s is the spin quantum number and x is the distance function within the particular system. This function is equal to unity when x=x' and decreases as the distance |x−x'| increases. Typically, it decays exponentially to zero at large distances, and the system is considered to be disordered. If, however, the correlation function decays to a constant value at large |x−x'|, then the system can be said to possess long-range order. If it decays to zero as a power of the distance, then it can be called quasi-long-range order. Note that what constitutes a large value of |x−x'| is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula $(Zr, Ti)_a(Ni, Cu, Fe)_b(Be, Al, Si, B)_c$, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula $(Zr, Ti)_a(Ni, Cu)_b(Be)_c$, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula $(Zr, Ti)_a(Ni, Cu)_b(Be)_c$, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula $(Zr)_a(Nb, Ti)_b(Ni, Cu)_c(Al)_d$, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1 and Table 2.

TABLE 1

Exemplary amorphous alloy compositions

| Alloy | Atm % | Atm % | Atm % | Atm % | Atm % | Atm % | Atm % | Atm % |
|---|---|---|---|---|---|---|---|---|
| 1 | Fe | Mo | Ni | Cr | P | C | B | |
| | 68.00% | 5.00% | 5.00% | 2.00% | 12.50% | 5.00% | 2.50% | |
| 2 | Fe | Mo | Ni | Cr | P | C | B | Si |
| | 68.00% | 5.00% | 5.00% | 2.00% | 11.00% | 5.00% | 2.50% | 1.50% |
| 3 | Pd | Cu | Co | P | | | | |
| | 44.48% | 32.35% | 4.05% | 19.11% | | | | |
| 4 | Pd | Ag | Si | P | | | | |
| | 77.50% | 6.00% | 9.00% | 7.50% | | | | |
| 5 | Pd | Ag | Si | P | Ge | | | |
| | 79.00% | 3.50% | 9.50% | 6.00% | 2.00% | | | |
| 5 | Pt | Cu | Ag | P | B | Si | | |
| | 74.70% | 1.50% | 0.30% | 18.0% | 4.00% | 1.50% | | |

TABLE 2

Additional Exemplary amorphous alloy compositions (atomic %)

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | | |
| | 50.75% | 36.23% | 4.03% | 9.00% | | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Zr | Ti | Fe | Be | | |
| | 35.00% | 30.00% | 2.00% | 33.00% | | |
| 13 | Au | Ag | Pd | Cu | Si | |
| | 49.00% | 5.50% | 2.30% | 26.90% | 16.30% | |
| 14 | Au | Ag | Pd | Cu | Si | |
| | 50.90% | 3.00% | 2.30% | 27.80% | 16.00% | |
| 15 | Pt | Cu | Ni | P | | |
| | 57.50% | 14.70% | 5.30% | 22.50% | | |
| 16 | Zr | Ti | Nb | Cu | Be | |
| | 36.60% | 31.40% | 7.00% | 5.90% | 19.10% | |
| 17 | Zr | Ti | Nb | Cu | Be | |
| | 38.30% | 32.90% | 7.30% | 6.20% | 15.30% | |
| 18 | Zr | Ti | Nb | Cu | Be | |
| | 39.60% | 33.90% | 7.60% | 6.40% | 12.50% | |

TABLE 2-continued

Additional Exemplary amorphous alloy compositions (atomic %)

| Alloy | Atm % | Atm % | Atm % | Atm % | Atm % | Atm % |
|---|---|---|---|---|---|---|
| 19 | Cu | Ti | Zr | Ni | | |
| | 47.00% | 34.00% | 11.00% | 8.00% | | |
| 20 | Zr | Co | Al | | | |
| | 55.00% | 25.00% | 20.00% | | | |

Other exemplary ferrous metal-based alloys include compositions such as those disclosed in U.S. Patent Application Publication Nos. 2007/0079907 and 2008/0118387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition Fe48Cr15Mo14Y2C15B6. They also include the alloy systems described by Fe—Cr—Mo—(Y,Ln)-C—B, Co—Cr—Mo-Ln-C—B, Fe—Mn—Cr—Mo—(Y,Ln)-C—B, (Fe, Cr, Co)—(Mo,Mn)—(C,B)—Y, Fe—(Co,Ni)—(Zr,Nb,Ta)—(Mo,W)—B, Fe—(Al,Ga)—(P,C,B,Si,Ge), Fe—(Co, Cr,Mo,Ga,Sb)—P—B—C, (Fe, Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions Fe80P12.5C5B2.5, Fe80P$^{11}$C5B2.5Si1.5, Fe74.5Mo5.5P12.5C5B2.5, Fe74.5Mo5.5P11C5B2.5Si1.5, Fe70Mo5Ni5P12.5C5B2.5, Fe70Mo5Ni5P11C5B2.5Si1.5, Fe68Mo5Ni5Cr2P12.5C5B2.5, and Fe68Mo5Ni5Cr2P11C5B2.5Si1.5, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}Al_5Ga_2P_{11}C_6B_4$. Another example is $Fe_{72}Al_7Zr_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature $T_x$. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blu-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

In accordance with embodiments, herein, there is a casting system or apparatus that utilizes a custom quartz crucible for melting and pouring non-wetting amorphous alloys (such as Fe-based, Ni-based, Au-based, Pt-based).

Figure 3:
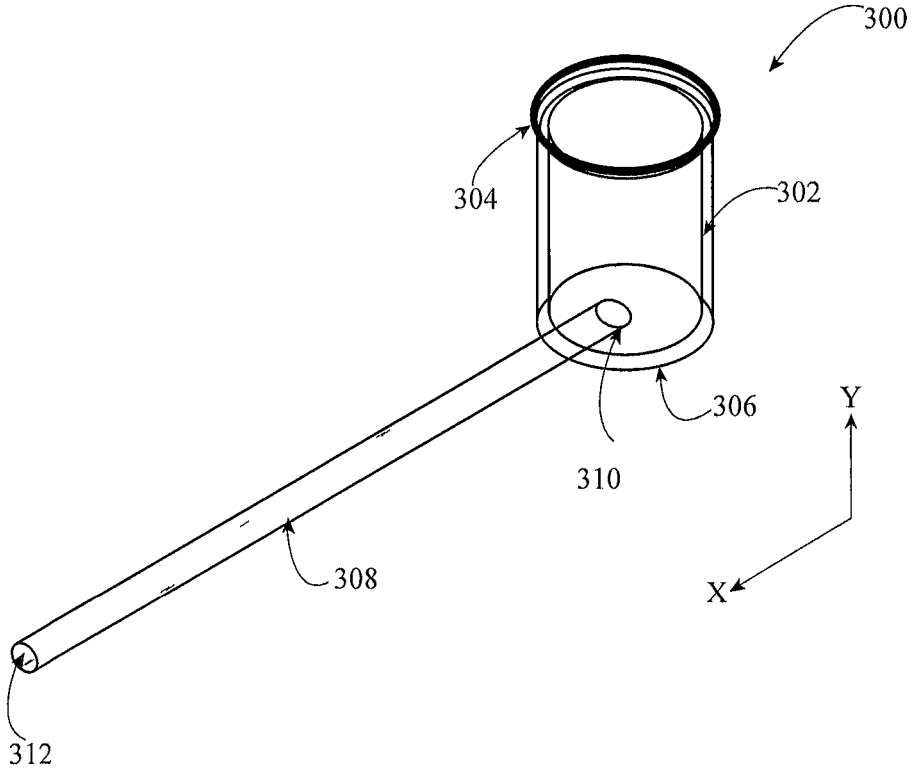
FIG. 3 illustrates a plan view of a schematic illustration of a crucible in accordance with an embodiment of this disclosure.
Figure 4:
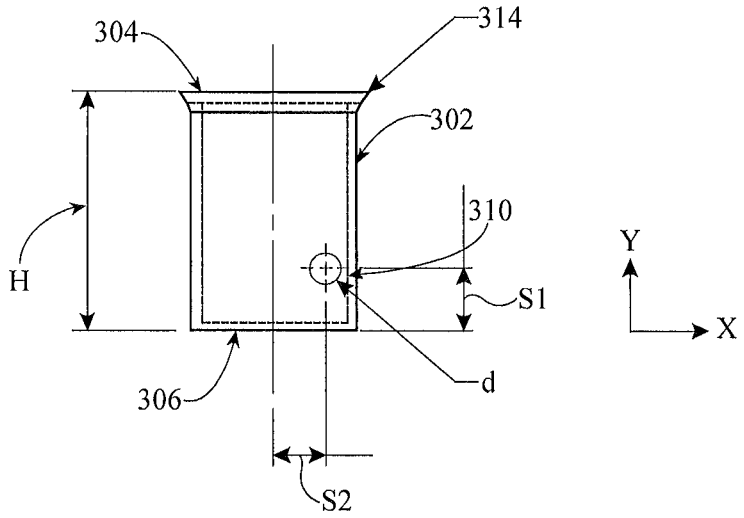
FIGS. 4 and 5 illustrate side and overhead views, respectively, of the crucible of FIG. 3.
Figure 5:
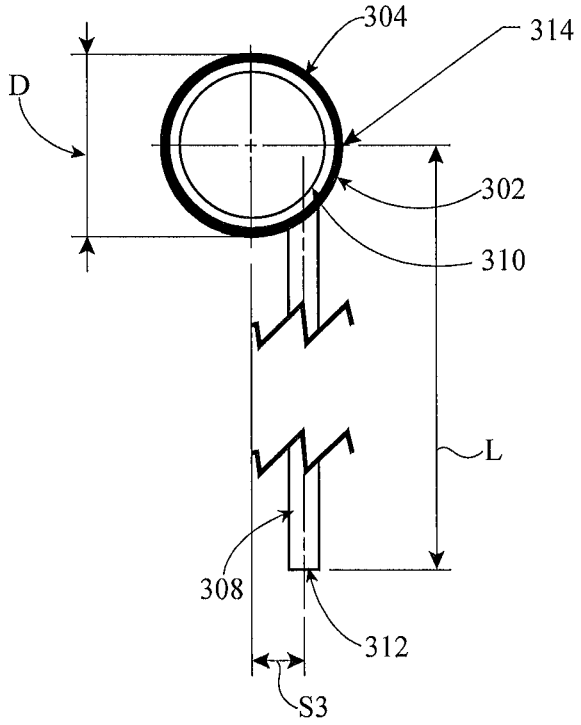

FIGS. 3-5 illustrate an example of a crucible design in accordance with an embodiment of this disclosure. The crucible 300, also referred to as a container herethroughout, has a body 302 with an open end 304 or opening providing access to a cavity and a closed, bottom end 306, as shown in FIG. 3. The open end 304 or opening includes a lip thereon as well as a pour spot location 314 (see FIGS. 4 and 5). The open end 304 or opening of the body 302 allows for receipt of an amorphous alloy material in a vertical direction (e.g., inserted downwardly through the open end 304 towards the bottom end 306 in a direction along a Y-axis). The body 302 may have a height H (see FIG. 4). In an embodiment, the height H is approximately 45 mm. The body 302 may have a diameter D (see FIG. 5). In an embodiment, the diameter D is approximately 33 mm.

Attached to the body 302 is a rod 308 or arm or handle. The rod 308 has a first end 310 and a second end 312. The first end 310 may be attached to the body 302. The rod 308 extends in a transverse or horizontal direction from the body 320 (in a direction along an X-axis). As described below, the second end 312 may be inserted and attached to an apparatus such that the rod 308 extends along a horizontal axis and rotates about the horizontal axis.

The rod 308 may have a length L (see FIG. 5) extending between its ends 310 and 312. In an embodiment, the length L is approximately 170 mm. The rod 308 may have a diameter d (see FIG. 4). In an embodiment, the diameter d is approximately 6.0 mm.

As shown in FIG. 3, in accordance with an embodiment, the rod 308 is attached to a bottom end 306 of the body 302 of the crucible 300 at a first end 310. In one embodiment, the first end 310 of the rod 308 is fused to the bottom end 306 of the crucible 300. In another embodiment, the rod 308 may be attached to a vertical side wall of the body 302 (e.g., at or near the bottom end 306), such as shown in FIG. 4. The rod 308 may be fused to the side wall of the crucible 300, for example. In an embodiment, the rod 308 is spaced and attached at a distance S1 away from or above the bottom end 306 of the body 302. In one embodiment, the distance S1 is approximately 12 mm.

The location for attaching or fusing the rod 308 to the body 302 can be based on a desired or optimal pouring condition. For example, in one embodiment, the rod 308 is attached so that it is offset from a center of the body 302 so that there is an off axis pour from the crucible 300, despite where the rod 308 is attached to the body 302 (on the vertical side wall or on the bottom end 306). That is, in an embodiment, an attachment portion (e.g., first end 310) of the rod 308 is displaced or offset from a centerline extending through the body 302. In an embodiment, the rod 308 may be attached and displaced a distance S2 away from a vertical centerline, as shown in FIG. 4. In one embodiment, the distance S2 is approximately 10 mm. In an embodiment, the rod 308 may be attached and displaced a distance S3 away from a horizontal centerline. In one embodiment, the distance S3 is approximately 10 mm.

In one embodiment, as shown in FIGS. 4 and 5, the rod 308 may be attached at the first end 310 to a vertical side wall of the body 302 and displaced both from a vertical centerline (FIG. 4) and a horizontal centerline (FIG. 5). In an embodiment, the distances S2 and S3 for displacement may be similar or equal to one another.

Off-axis attachment of the rod 308 to the container body 302 allows for easier pouring of any molten material within the cavity. By having an off-axis pour of the crucible, this allows the pour spout 314 of the crucible 300 to be above a pour receiving hole of a shot sleeve or a mold in an apparatus, thus ensuring that no molten material is lost during the pour.

The body 302 of the crucible 300 and the rod 308 are formed from silica or quartz. In one embodiment, the crucible 300 (including rod 308) are formed from fused silica, quartz, fused quartz, clear fused quartz, or combinations thereof. Silica or quartz resists wetting of many amorphous metals, which in turn allows for a perfectly clean pour of material without any inclusions being imparted into the melt. Melting material in quartz keeps the material very clean and avoids contamination in the melt. Further a quartz crucible allows for melting of BMG alloys with higher purity, prevents sticking of BMG alloys so that a BMG part can be approximately 100% amorphous when cast or molded.

The term "wetting" is readily understood in the art. In some embodiments, the lack of wetting can refer to a lack of significant amount of the alloy observed on the inner wall of the crucible after the molten alloy is melted. The presence of alloy element(s) on the wall can be due to physical interaction/reaction (e.g., adsorption) between the alloy and the crucible or chemical interaction/reaction (e.g., chemical reaction). In one embodiment, a lack of wetting can refer to the inner wall of the crucible as substantially free of the alloy thereon, save some trace amount. The herein disclosed crucible 300 also can minimize inter-diffusion and/or contamination between the elements from the alloy and those of the crucible and/or the crucible assembly as a whole.

The lack of wetting can also be reflected in a lack of reaction (chemical or physical) between the elements of the molten alloy and those of the crucible. In one embodiment, the crucible 300 can substantially prevent the molten alloy inside the crucible from reacting with the crucible at the interface between the two. Such a reaction is also sometimes referred to as "attack" on the wall of the crucible, or, alternatively, "contamination" of the alloy charge.

In one embodiment, the "attack" (or "contamination") may be quantified by either measuring the concentration of impurity elements in the final melted alloy (indicating the degree to which the elements of the crucible have entered the alloy) or by the deviation of the main elements of the final melted alloy from the desired nominal composition (indicating diffusion of alloy elements into the crucible). This can involve measurement of the alloy composition and comparison with the nominal composition in terms of both the main constituents and also impurity elements, such as oxygen, carbon, nitrogen, sulfur, hydrogen, and the elements of the crucible. The tolerance for impurity elements depends on the actual alloy composition being melted. Moreover, one additional measure of "attack" could also be the thickness of the crucible wall after processing, indicating whether substantial amounts of the container material have dissolved into the molten alloy.

The disclosed crucible 300 substantially minimizes and/or eliminates any attack or contamination to the molten alloy material and/or the crucible 300 itself.

The herein disclosed crucible 300 is also re-useable, since the quartz body 302 and rod 308 are both capable of withstanding high temperatures and a vacuum or inert environment.

As previously noted, metal metalloid glasses (B, Si, P, C) cannot be cast using a water-cooled boat design. Fragile glasses (such as Fe-based, Ni-based, Au-based, Pt-based) are also not able to produce an amorphous part in in-line melt systems (e.g., when using a copper water-cooled boat). This is because these alloys tend to crystallize extremely fast, especially if the metal is not overheated entirely. Water-cooled boats tend to always leave a skull of crystals that significantly hurt the glass formability of these alloys. Such glasses, can, however, be molten and cast using the disclosed crucible 300. With a quartz crucible as disclosed herein, the entire melt is brought up above the overheat temperature which provides enough time to make a fully amorphous part. In particular, the melt or molten material is uniform in temperature and thus uniformly overheats to prevent cooling of the material or crystals from forming (as noted in the prior art). Further, PE-based alloys can be heated in crucible 300 without being exposed to crystallization like the prior art methods (none or close to no crystallization). Other technology(ies) to produce these alloys have a much longer cycle time and also have a number of consumable items that are lost for each cast (counter-gravity casting system). The herein disclosed quartz crucible allows the material (amorphous alloy) therein to be overheated to dissolve crystals in the melt or molten material without greatly increasing the cycle time or loss of consumables.

Some metallic glass materials will not work with pure quartz (Zr-based, Ti-based, etc.) as they will wet (stick) to the quartz and pull it apart. Accordingly, in an embodiment, the crucible 300 is formed from silica or quartz that is unpure.

Figure 6:
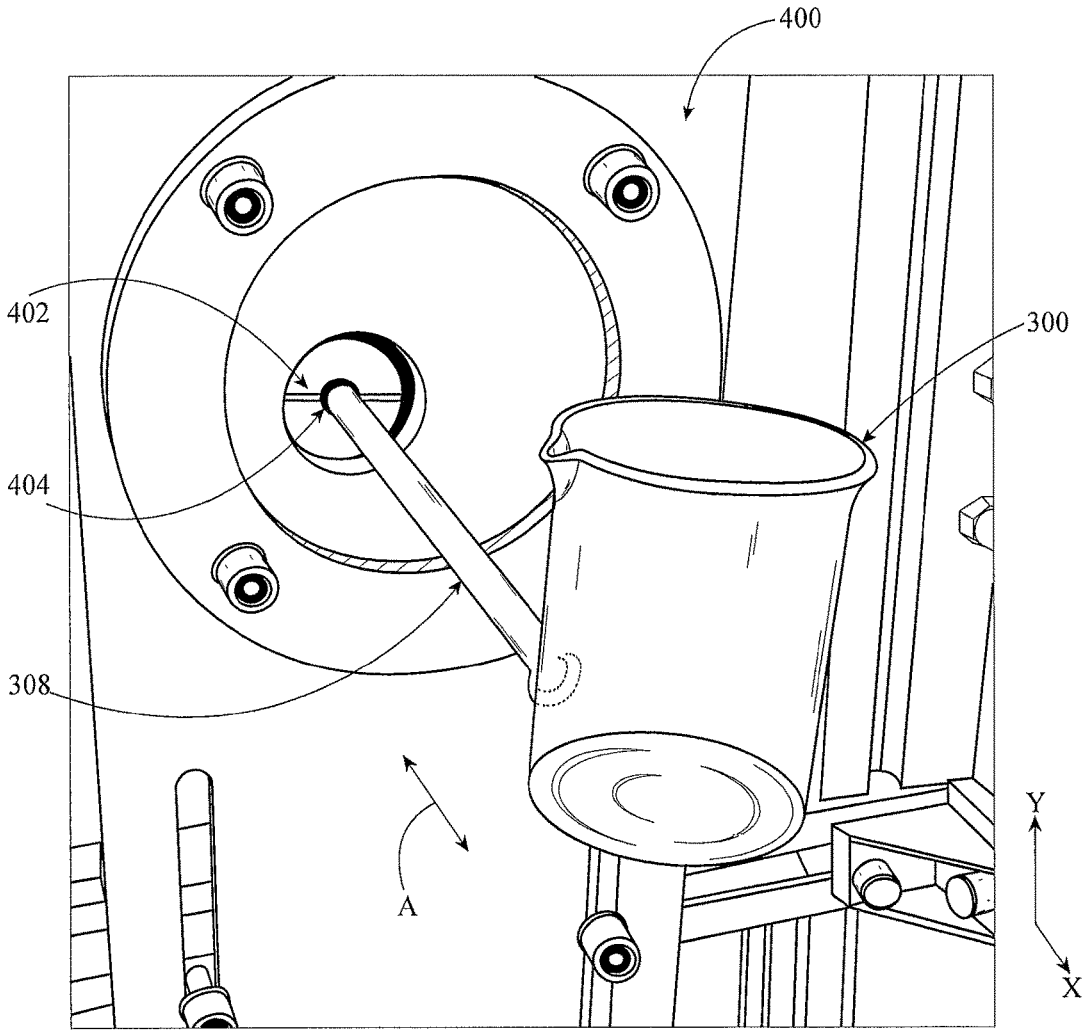
FIG. 6 illustrates a handle of the crucible of FIG. 3 mounted in an apparatus in accordance with an embodiment of this disclosure.

FIG. 6 shows the crucible 300 when inserted and mounted in an apparatus 400. As shown, the crucible 300 may be empty upon insertion and mounting with the apparatus 400. The apparatus may be a casting system similar to a die-cast machine for pouring molten material into a shot sleeve and then a plunger would actuate forward through the shot sleeve to push the molten material from the shot sleeve and into a mold. As shown, the rod 308 is inserted into an opening 404 in a plunger 402 of the apparatus 400. The plunger 402 is configured to selectively move the rod 308 and thus the body 302 of the crucible 300 along a horizontal axis (along an X-axis) in a horizontal direction as indicated by arrow A, for example. The plunger 402 is also configured to pivot or rotate the crucible 300 about the horizontal axis in both directions.

Figure 7:
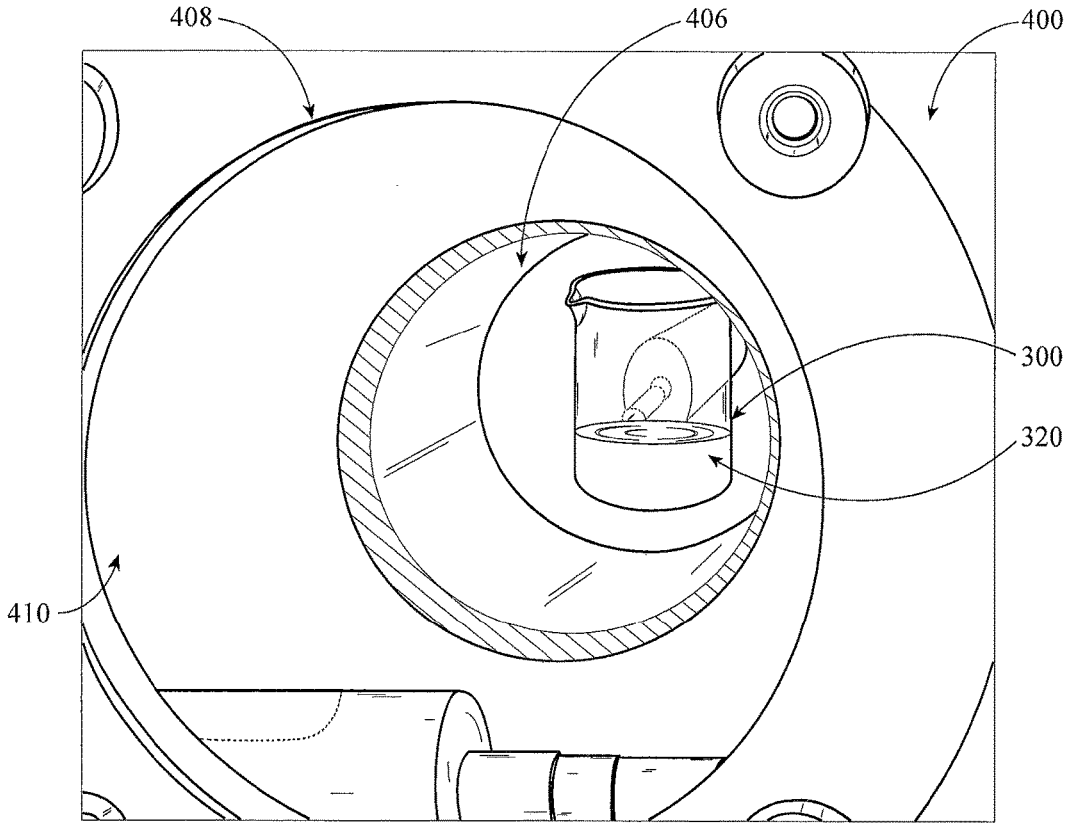
FIGS. 7-15 illustrate a method of use of the crucible of FIG. 3 and exemplary steps in melting, moving and pouring with the crucible in an apparatus for casting in accordance with an embodiment of this disclosure.

FIGS. 7-15 illustrate a method of use of the crucible 300 in the apparatus 400. As shown in FIG. 7, the crucible 300 is enclosed within a vacuum environment 408 in the apparatus 400. The crucible 300 is one made of silica or quartz, as described above. The amorphous alloy material 320 for melting that is provided inside the body 302 of the crucible 300 does not wet or dissolve the container substantially during the method of melting. In an embodiment, the crucible 300 holds a non-wetting alloy material 320 which is melted by an adjacent heat source 406, such as an induction coil or furnace. In an embodiment, an amorphous alloy material is provided in the cavity or container body 302 for melting.

As shown in FIG. 7, the material 320 may be heated in the crucible 300 using the heat source 406 to a temperature above a melting temperature of the amorphous alloy material 320. At least a part of the heating in the apparatus 400, for example, can be conducted by inductive heating, such as one inductive heating carried out by RF frequency. The heating can be carried out in under a partial vacuum, such as low vacuum, or even high vacuum, to avoid reaction of the alloy with air. In one embodiment, the vacuum environment 408 can be at about 10-2 torr or less, such as at about 10-3 torr or less, such as at about 10-4 torr or less. Alternatively, the step of heating and/or pouring (described below) and/or molding (also described below) can be carried out in an inert atmosphere, such as in argon, nitrogen, helium, or mixtures thereof. Non-inert gas, such as ambient air, can also be used, if they are suitable for the application. In another embodiment, it can be carried in a combination of a partial vacuum and an inert atmosphere. In one embodiment, the heating can be conducted by vacuum induction melting. The heating can also be carried out in an inert atmosphere, such as one with argon.

Figure 8:
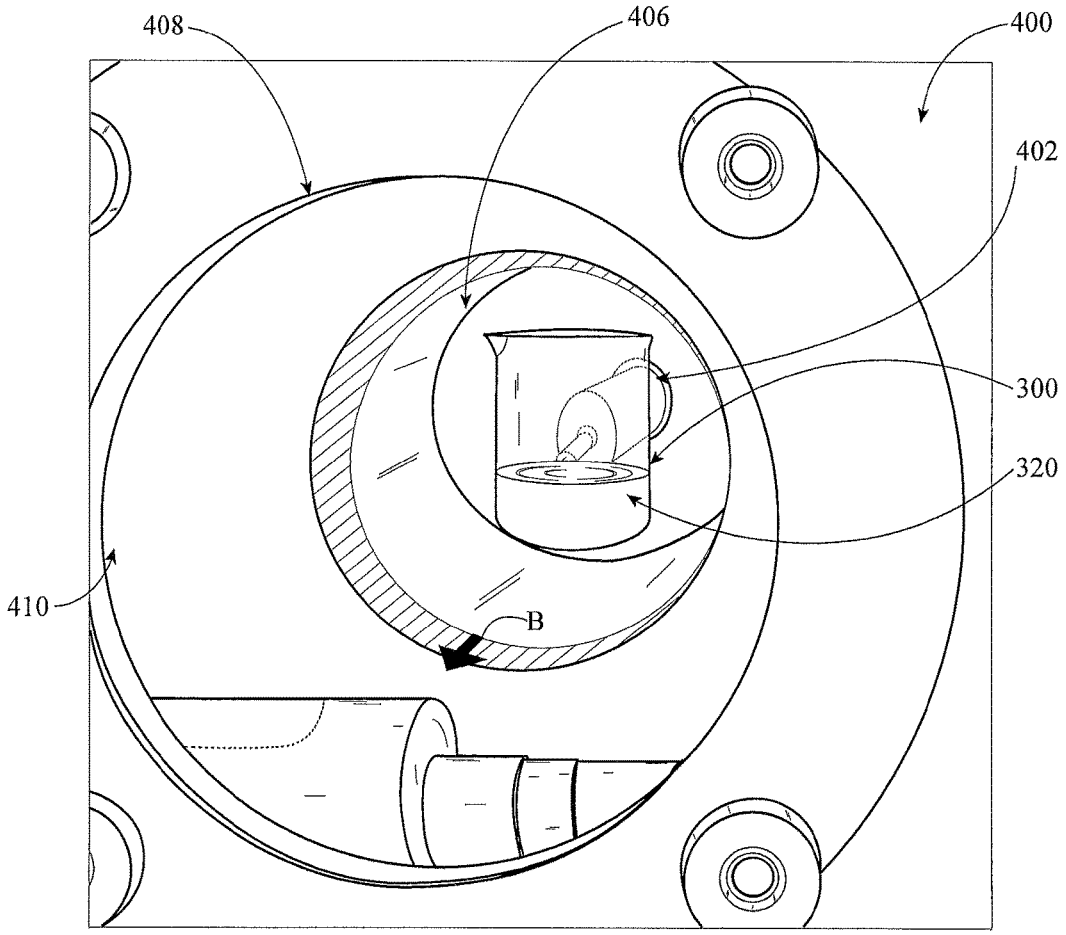

After melting, the crucible 300 may be advanced towards a pour location 410 in the apparatus 400, as shown in by the arrow B in FIG. 8. For example, the plunger 402 may be used to move the crucible 300 (via moving the rod 308) in a horizontal direction away from the heat source 406 after heating. The plunger 402 may be configured to move the crucible into a pour location 410, which may be near or adjacent a mold. The pour location 410 may include a shot sleeve therein (not shown). In an embodiment, the pouring location 410 includes a shot sleeve located below the horizontal axis for moving the crucible 300.

Figure 9:
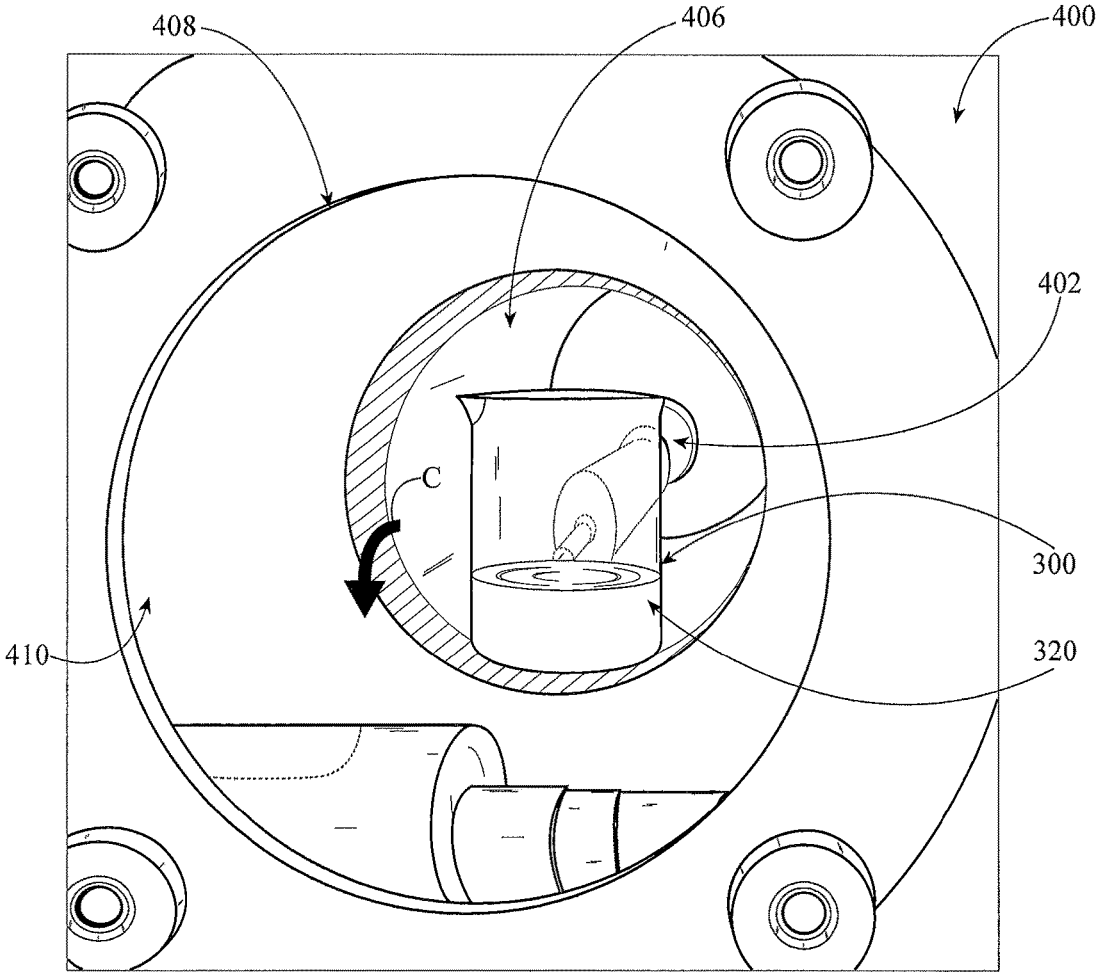
Figure 10:
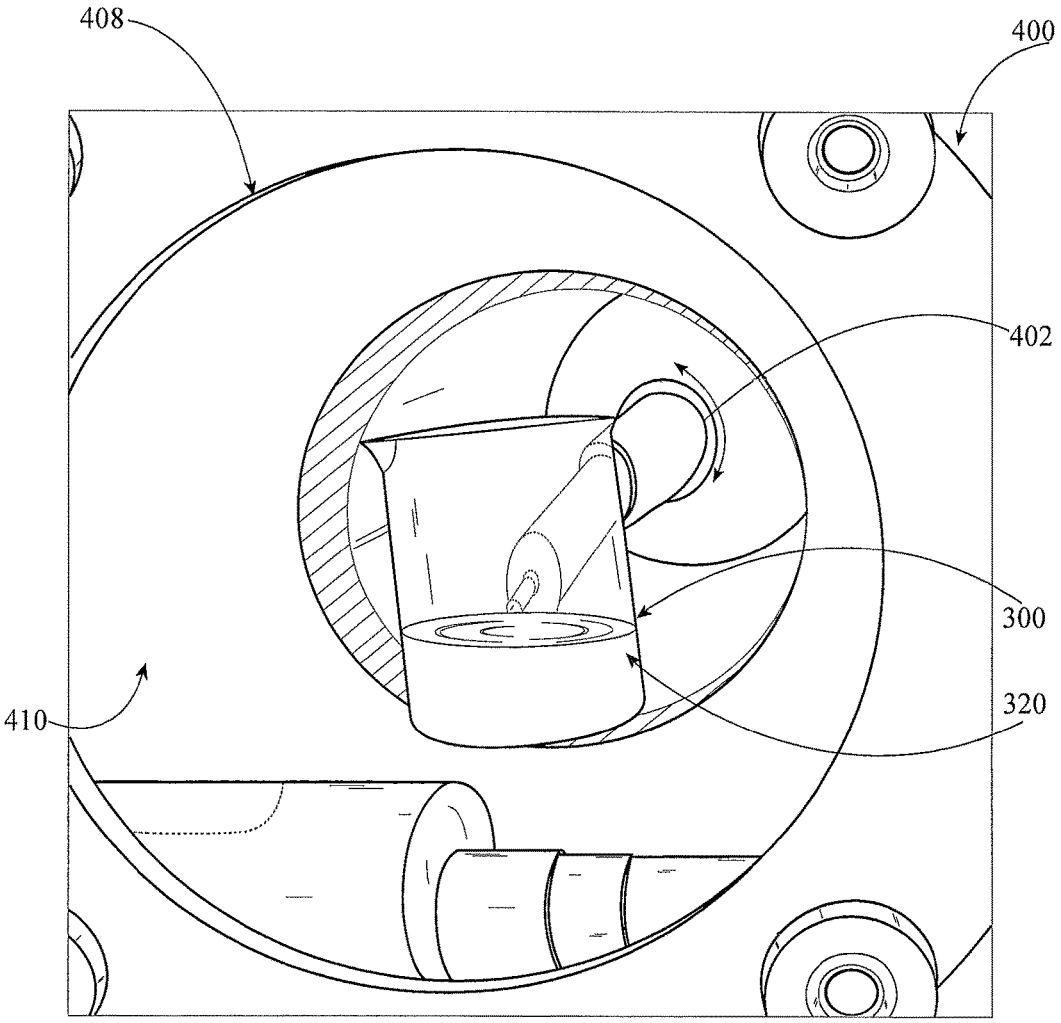
Figure 11:
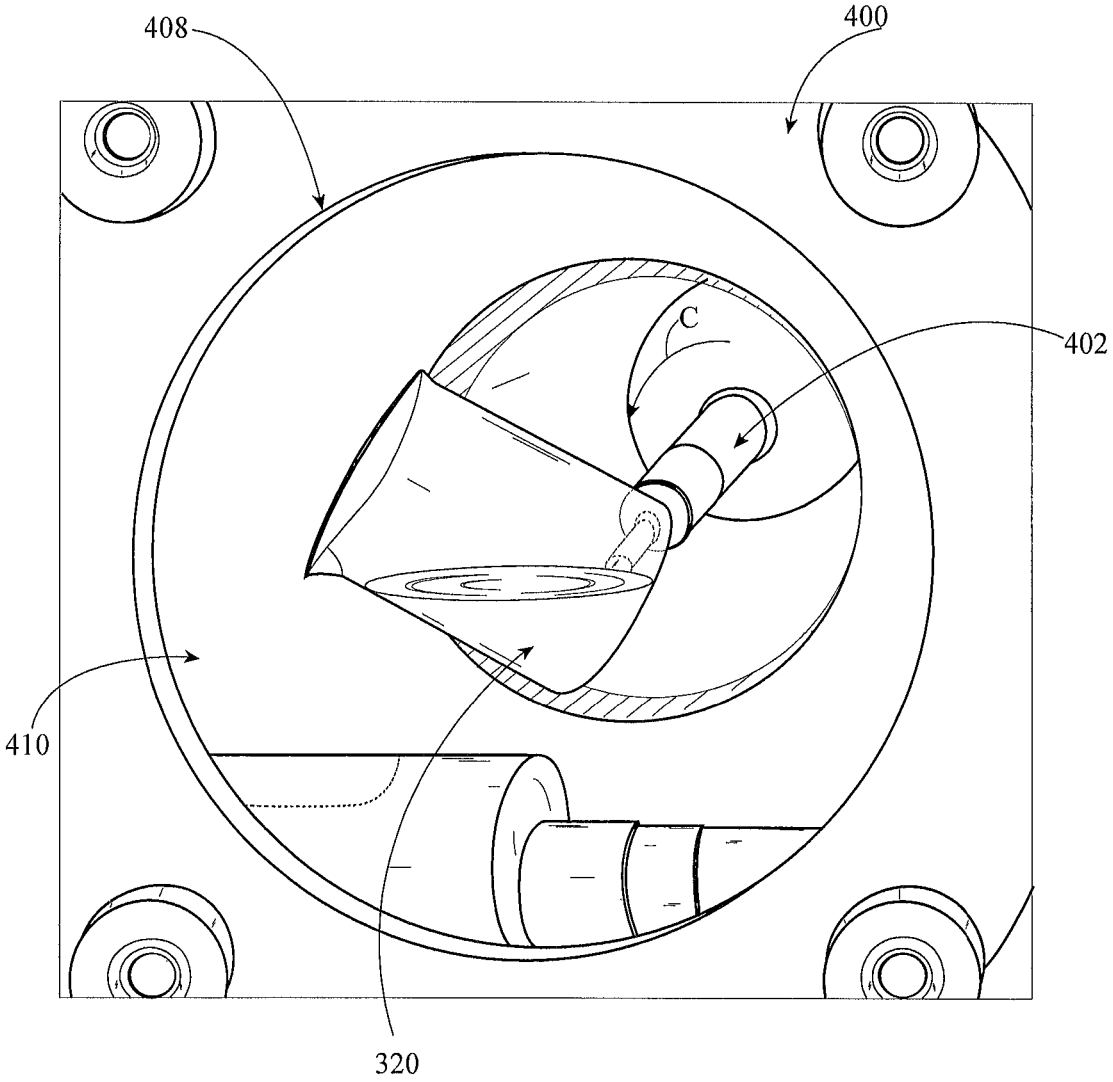
Figure 12:
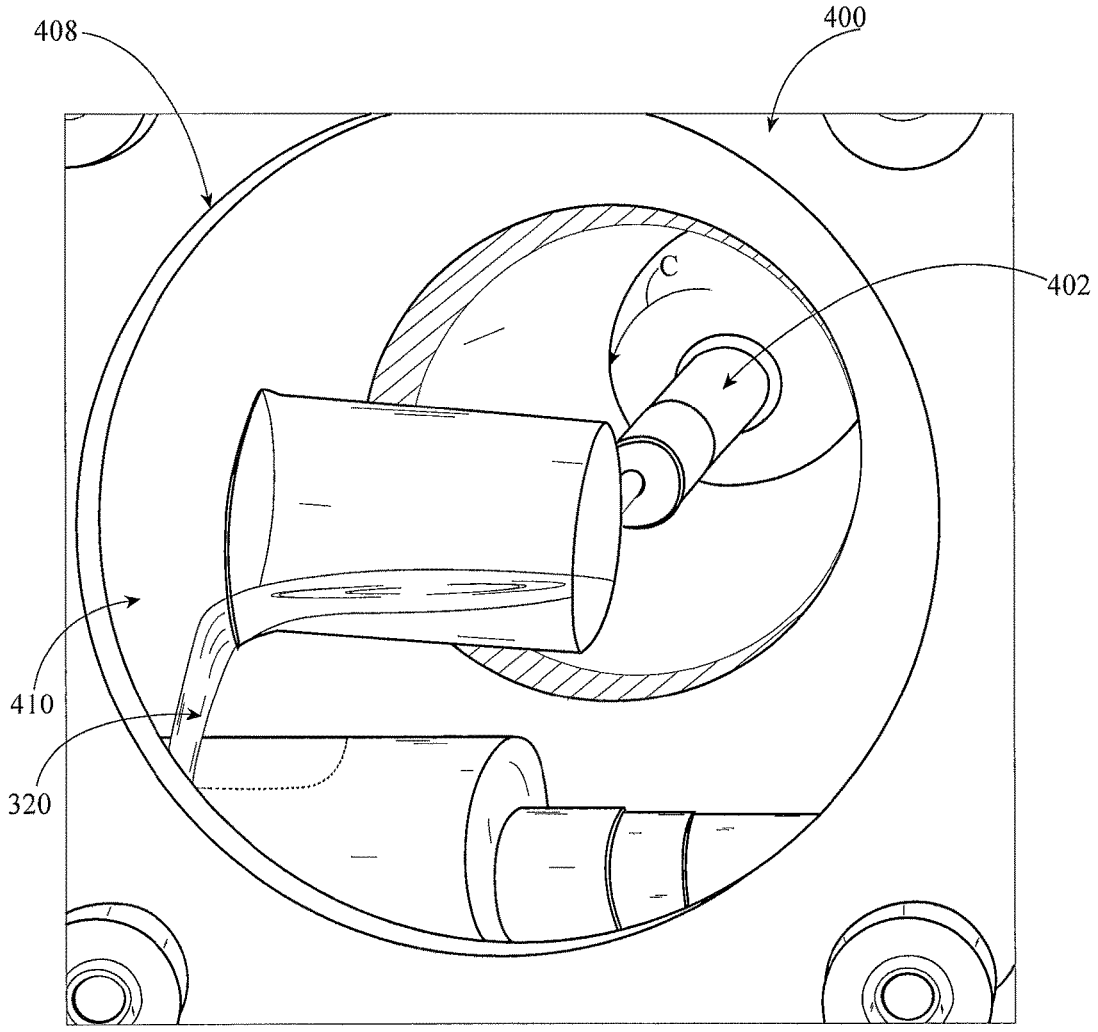
Figure 13:
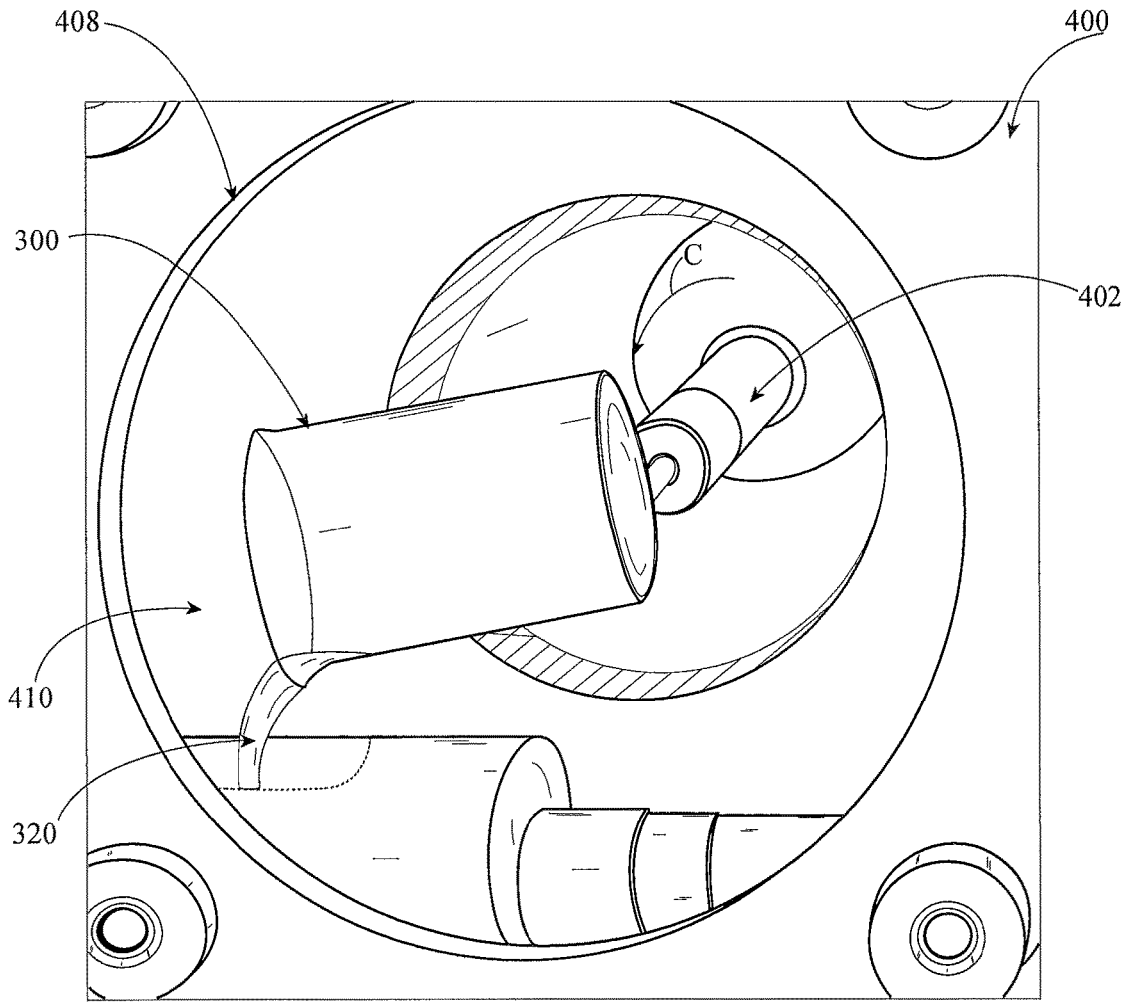

Once positioned over the pouring location, as shown in FIG. 9, the rod 308 of the crucible 300 can be rotated by the plunger 402 about the horizontal axis in a first direction as indicated by arrow C so that the crucible 300 can begin to pour the molten material out of its cavity via the pour spout 314, as shown in FIG. 10. FIGS. 11, 12, and 13 illustrate the pivotal or rotational movement of the crucible as the rod 308 is continually is rotated about the horizontal axis in the first direction (arrow C) and the molten material is poured out of the body 302 of the crucible 300.

In one embodiment, the molten amorphous alloy material is poured from the crucible 300 into a shot sleeve. In one embodiment, the molten amorphous alloy material is poured from the crucible 300 into a mold.

Figure 14:
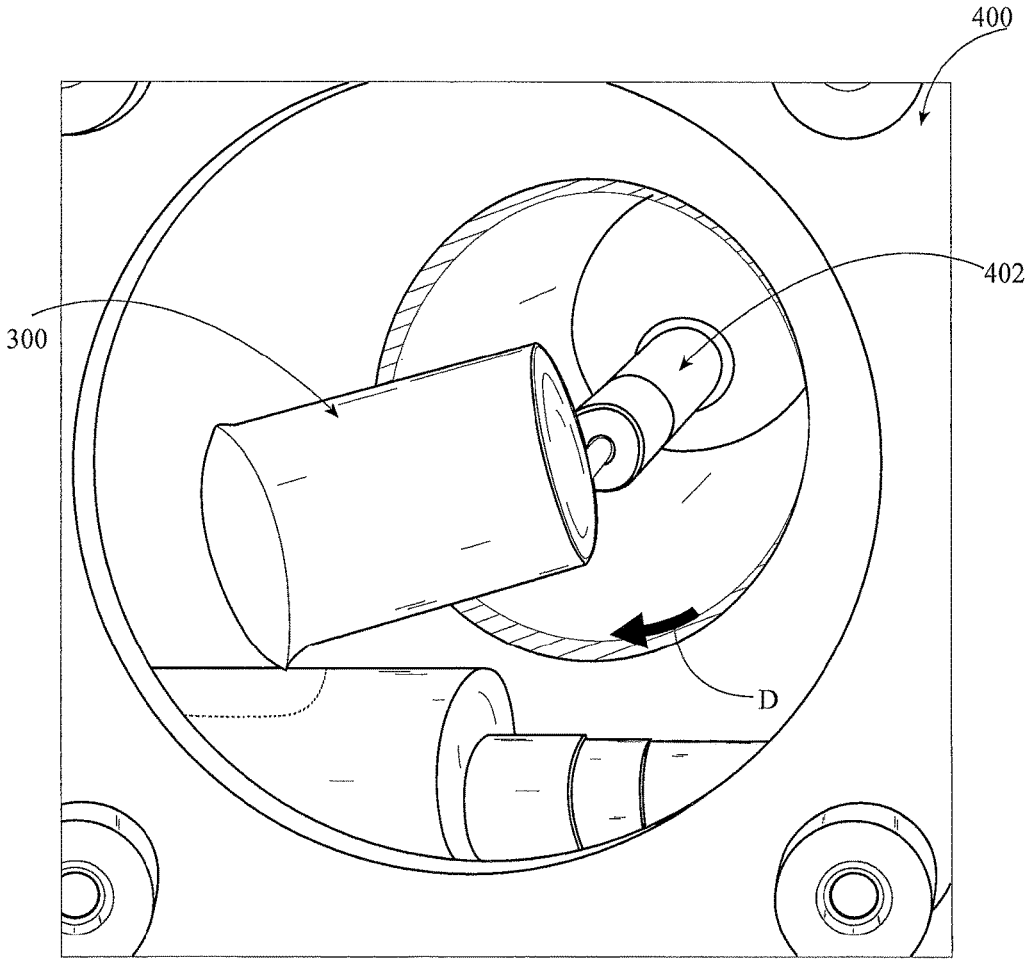
Figure 15:
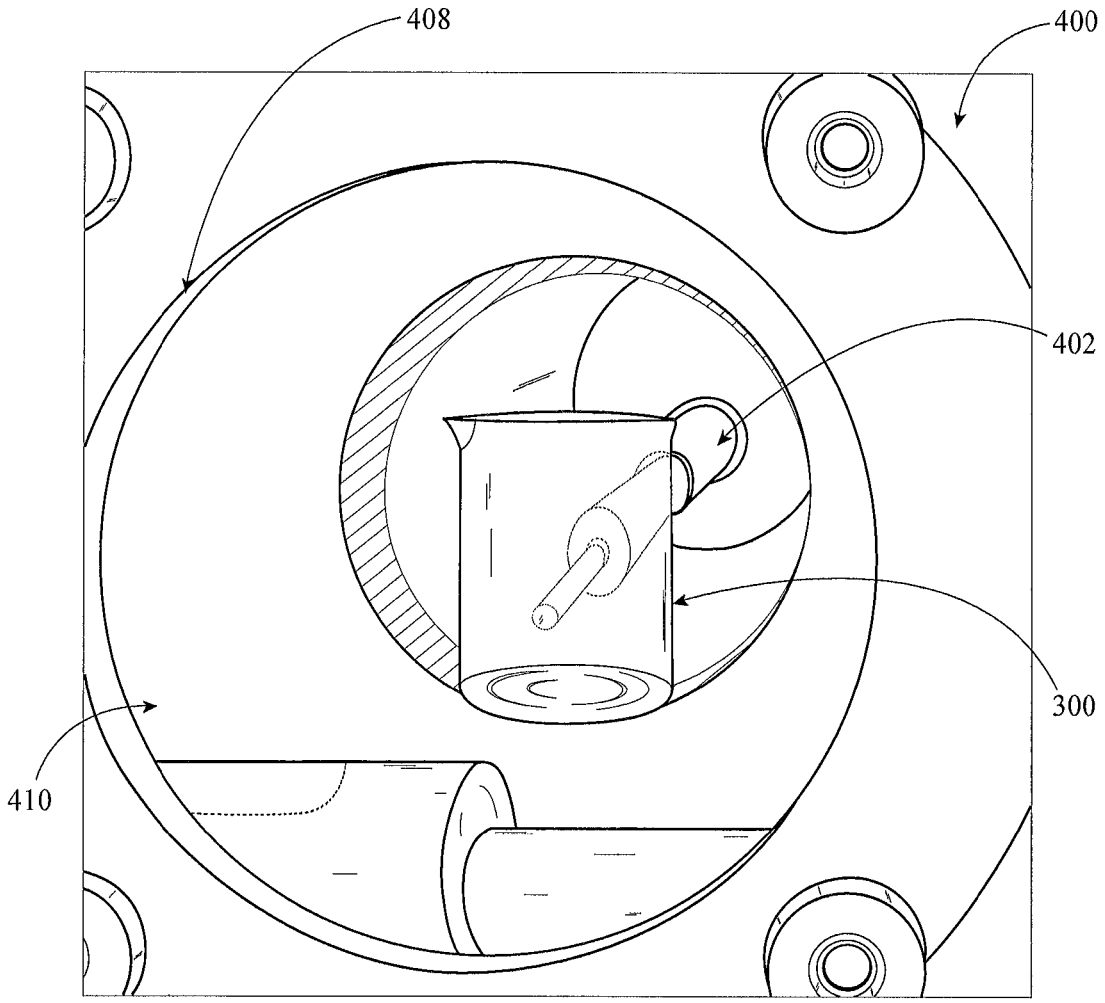

As shown in FIG. 14, after pouring is finished, there is no residue leftover. The handle can then be rotated in a second direction as indicated by arrow D (i.e., in an opposite direction to the first direction) about the horizontal axis to position the crucible 300 in an upright position, such as shown in FIG. 15. The crucible 300 may then be withdrawn from the pour location 410 of the apparatus.

In an embodiment, the method further includes molding the molten amorphous alloy material in a mold.

As previously noted, one or more of the steps of the herein disclosed method for using the crucible 300 may be performed in an inert or vacuum environment 408 within the apparatus 400. In an embodiment, the heating and pouring is performed under vacuum. In an embodiment, the heating, pouring, and molding is performed under vacuum.

Although silica and quartz materials are described herein as being used to form the crucible 300, other materials that do not melt molten BMG may be used in accordance with embodiments herein. That is, a body 302 with an offset rod 308 may be formed from one or more other materials, including, but not limited to, sulfites such as aluminum and zirconium.

Also, the materials that are melted in the crucible are not intended to be limiting. Such materials may include, but are not limited to, boron, silicon, carbon, paladium, platinum, phosphorous, gold silicon, nick phosphorous, nickel boron, iron silicon, and iron borne materials, and/or other bulk amorphous alloys.

Though the embodiments discussed herein are made with reference to FIGS. 1-15, those skilled in the art will readily appreciate that the detailed description given herein with respect to these Figures is for explanatory purposes only and should not be construed as limiting.

As described above, the presently described articles can be used in a melting and/or an alloying process. A melting process in one embodiment can include providing a mixture of alloy elements (or alloy charge) to be alloyed; and heating the mixture in a crucible to a temperature above a melting temperature of the alloy elements. The alloy in one embodiment refers to an alloy that is at least partially amorphous, although the alloy in some instances can also refer to crystalline alloys. In one embodiment, the alloy is a BMG.

Further, it should be understood that the terms used herein, including molten alloy, molten metal, molten amorphous alloy, amorphous alloy, BMG, and the like are not intended to be limiting, but also understood to refer to bulk-solidifying amorphous alloys, or bulk metallic glasses ("BMG") that are used in the herein disclosed mold to form BMG parts.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. A crucible comprising:

a body formed from silica or quartz and defining a cavity extending from an open end to a closed end along a vertical axis; and a rod formed from a silica or quartz and fused to a sidewall of the body of the crucible at a location that is offset from a vertical centerline through the body and is offset below a horizontal plane bisecting the body.

2. The crucible of claim 1, wherein the cantilevered rod does not extend into the cavity.

3. The crucible of claim 1, wherein the cantilevered rod does not span the open end of the body.

4. The crucible of claim 1, wherein the body and the rod are formed from quartz.

5. The crucible of claim 1, wherein the body and the rod are formed from silica.

6. The crucible of claim 1, wherein the location is offset from the vertical centerline by about 10 mm.

7. The crucible of claim 1, wherein the location is offset from a bottom of the closed end by about 12 mm.

8. A method comprising:

melting, using a heat source, an amorphous alloy material in a container comprising silica, thereby forming a molten material; and moving the container in a horizontal direction away from the heat source and towards a mold after melting the material.

9. The method of claim 8, wherein the container comprises fused silica, quartz, fused quartz, clear fused quartz, or combinations thereof.

10. The method of claim 8, further comprising pouring the molten material from the container into a shot sleeve.

11. The method of claim 10, wherein:

the method further comprises positioning the container an environment that is inert or under vacuum; and the operations of melting the amorphous alloy material and pouring the molten material into the shot sleeve are performed under vacuum.

12. The method of claim 8, further comprising pouring the molten material from the container into a mold.

13. The method of claim 12, further comprising molding the molten material in the mold.

14. The method of claim 13, wherein:

the method further comprises positioning the container an environment that is inert or under vacuum; and the operations of melting the amorphous alloy material, pouring the molten material into the mold, and molding the molten material are performed under vacuum.

15. The method of claim 8, further comprising, after moving the container in the horizontal direction away from the heat source and towards the mold, rotating the container about an axis that is offset from a vertical centerline and is below a horizontal plane bisecting the container.

16. A method comprising:

melting an amorphous alloy material in a container comprising silica, thereby forming a molten material;

positioning the container over a receptacle; and rotating a rod that extends from a portion of the container that is offset from an axial centerline and is below a plane perpendicular to the axial centerline and bisecting the container, thereby pouring the molten material from the container into the receptacle.

17. The method of claim 16, wherein the container comprises fused silica, quartz, fused quartz, clear fused quartz, or combinations thereof.

18. The method of claim 16, further comprising, after melting the amorphous alloy material, moving the container in a horizontal direction away from a heat source and towards a mold.

19. The method of claim 16, wherein rotating the rod comprises rotating a plunger that is attached to the rod.

20. The method of claim 16, wherein:

the receptacle is a mold; and the method further comprises forming a part, in the mold, from the amorphous alloy material.

21. The method of claim 16, wherein:

the method further comprising positioning the container an environment that is inert or under vacuum and the operations of melting the amorphous alloy material is performed under vacuum.

22. The method of claim 16, wherein:

the receptacle is a shot sleeve; and the method further comprises pushing the molten material through the shot sleeve and into a mold using a plunger.

23. A crucible comprising:

a body formed from silica or quartz and defining a cavity extending from an open end to a closed end along a central axis; and a rod formed from silica or quartz and cantilevered from the body of the crucible, wherein: the rod is fused to the body of the crucible at a location that is offset from the central axis and is closer to the closed end of the body than the open end of the body.

* * * * *